US005542127A

United States Patent [19]

Bezanis

[11] Patent Number: 5,542,127

[45] Date of Patent: Aug. 6, 1996

[54] COMBINED BANDANA AND VISOR HEADWEAR

[76] Inventor: Matthew Bezanis, 3113 Fairfield St., Philadelphia, Pa. 19136

[21] Appl. No.: 542,609

[22] Filed: Oct. 13, 1995

[51] Int. Cl.[6] ..... A42B 1/06

[52] U.S. Cl. ..... 2/172; 2/181; 2/195.1; 2/195.5; 2/207

[58] Field of Search ..... 2/171, 172, 175.1, 2/175.4, 181, 195.1, 195.5, 207

[56] References Cited

U.S. PATENT DOCUMENTS

| | | | |
|---|---|---|---|
| 2,704,366 | 3/1955 | Arnold | 2/172 |
| 2,740,567 | 4/1956 | Kaufman | 2/195.5 |

FOREIGN PATENT DOCUMENTS

| | | | |
|---|---|---|---|
| 965688 | 9/1950 | France | 2/207 |

*Primary Examiner*—Diana Biefeld
*Attorney, Agent, or Firm*—Caesar, Rivise, Bernstein, Cohen & Pokotilow, Ltd.

[57] ABSTRACT

An article of headwear providing the advantages of a bandana and that of a baseball-type cape. The article includes a visor brim in the form of a bill, a self-supporting upstanding crown, and a triangular bandana cloth. The bill has a front edge and an arcuate rear edge. The bandana is formed of a flexible fabric having an outer surface, an inner surface, a front edge and a pair of angularly extending side edges. The front edge merges with each of the side edges in a pair of pointed ends, while the side edges merge with each other in another pointed end. The rear edge of the bill is fixedly secured to the front edge of bandana cloth. The crown is a generally triangular shaped, slightly concave member having a concave inner surface, a convex outer surface, and a bottom edge. The crown is disposed under and secured to the bandana cloth so that the inner surface of the bandana cloth engages the convex surface of the crown. The bottom edge of the crown is secured to the arcuate rear edge of the bill to form a self-supporting portion headwear arranged disposition on the forehead of the person wearing the headwear, whereupon the brim is located above the person's eyes. The remaining portion of the bandana cloth can be disposed over the person's head and with the pointed ends thereof being tieable to one another to secure the headwear in place. The portion of the bandana cloth disposed over the crown preferably has indicia thereon, e.g., the logo of a team, to be readily visible.

6 Claims, 3 Drawing Sheets

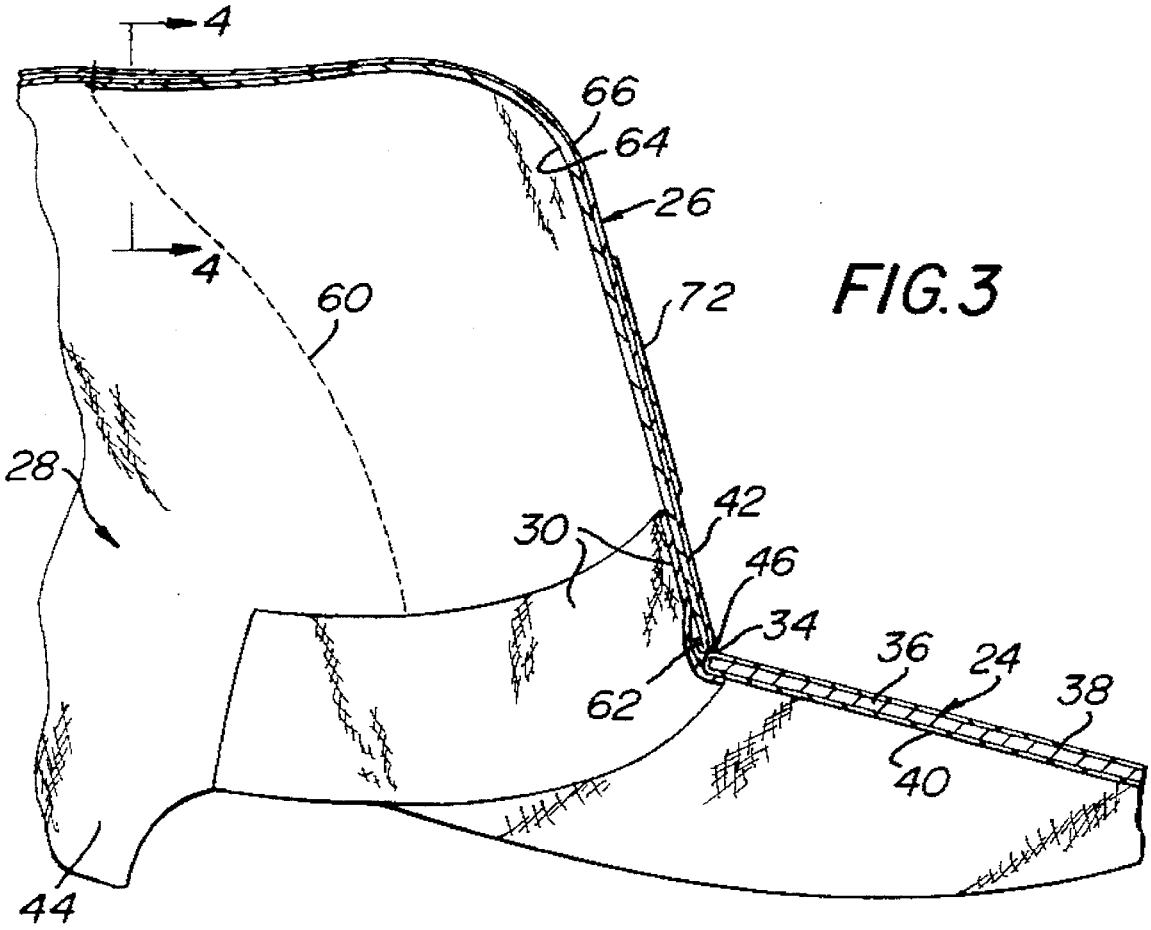
FIG.3
FIG.4
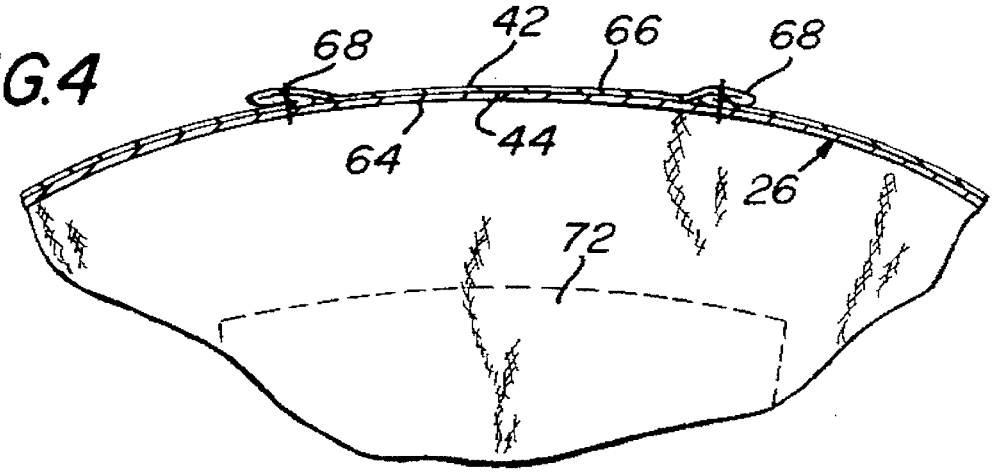

COMBINED BANDANA AND VISOR HEADWEAR

BACKGROUND OF THE INVENTION

This invention relates generally to apparel, and more particularly to items to be worn on the head as a cap or bandana.

Bandana-like articles of apparel have been disclosed in the patent literature to produce headwear including a brim to shade the eyes of the wearer, and thus overcome one disadvantage of a simple bandana, i.e., the inability to provide shading for the wearer's eyes. Examples of such patents are U.S. Pat. Nos. 2,005,361 (Rollins et al.), 2,859,448 (Gaichel), 5,253,369 (Patterson), and 5,381,559 (Wakefield, Ill.).

While the bandana-like headwear aforementioned patents appear generally suitable for their intended purposes, they never the less leave something to be desired from the standpoint of functionality, e.g., the ability to simulate a baseball type of cap having a self supporting crown to facilitate positioning of the headwear in place on the wearer's head, while also providing an upstanding area on which graphic material, e.g., a team logo, can be placed for ready visibility.

Hence, a need presently exists for headwear which addresses those deficiencies of the prior art.

OBJECTS OF THE INVENTION

Accordingly, it is a general object of this invention to provide an article of headwear which overcomes the disadvantages of the prior art.

It is a further object of this invention to provide an article of headwear which provides the aesthetic appeal of a bandana with the functional advantages of a baseball type cap.

It is still a further object of this invention to provide an article of headwear which is easy to put on and take off.

It is yet a further object of this invention to provide an article of headwear which is simple in construction.

SUMMARY OF THE INVENTION

These and other objects of this invention are achieved by providing an article of headwear for disposition on the head of a person. The article basically comprises a visor brim, a crown, and a bandana cloth.

The visor brim is in the form of a bill of a flexible, yet self-supporting material, and has a front edge and an arcuate rear edge. The bandana cloth comprises a triangular shaped flexible fabric having an outer surface, an inner surface, a front edge and a pair of angularly extending side edges. The front edge of said bandana cloth has a central portion. The front edge of the bandana cloth merges with each of the side edges in a pair of pointed ends, while the side edges merge with each other in another pointed end.

The arcuate rear edge of the bill is fixedly secured to the central portion of the front edge of said bandana cloth between the pointed ends.

The crown is a generally triangular shaped, slightly concave member having a concave inner surface, a convex outer surface, a bottom edge and a pair of angularly extending side edges. The crown is disposed under said bandana cloth with the inner surface of the bandana cloth engaging, e.g., secured to, the convex surface of the crown. The bottom edge of the crown is secured to the arcuate rear edge of the bill to form a self-supporting portion of the article of headwear. That self-supporting portion is arranged disposition on the forehead of the person wearing the article of headwear so that the brim is located above the person's eyes. The remaining portion of the bandana cloth can be disposed over the person's head and with the pointed ends thereof being releasably securable to one another to secure the headwear in place.

In accordance with one preferred aspect of this invention the bandana cloth disposed over the self-supporting portion of the article of headwear has indicia thereon, e.g., the logo of a team, to be readily visible to all.

DESCRIPTION OF THE DRAWINGS

Other objects and many attendant features of this invention will become readily appreciated as the same becomes better understood by reference to the following detailed description when considered in connection with the accompanying drawings wherein:

FIG. 3 is an enlarged sectional view taken along lines 3—3 of FIG. 2;

FIG. 4 is a sectional view taken along lines 4—4 of FIG. 3;

DETAILED DESCRIPTION OF THE PREFERRED EMBODIMENTS

Figure 1:
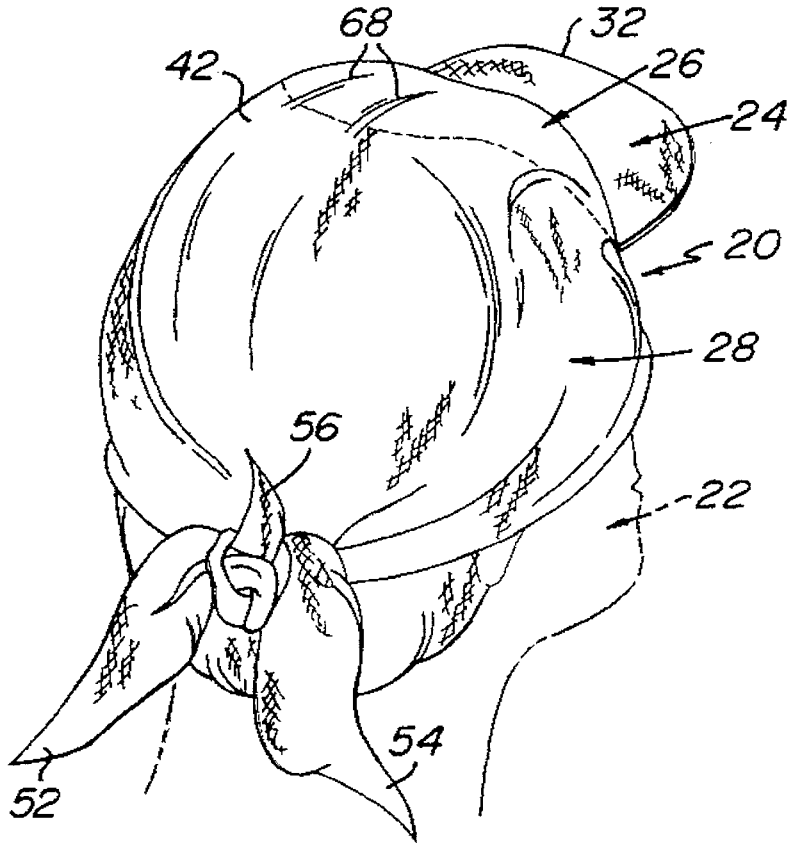
FIG. 1 is an isometric view of the rear portion of an article of headwear shown worn on the head of a person and constructed in accordance with one embodiment of the subject invention.
Figure 2:
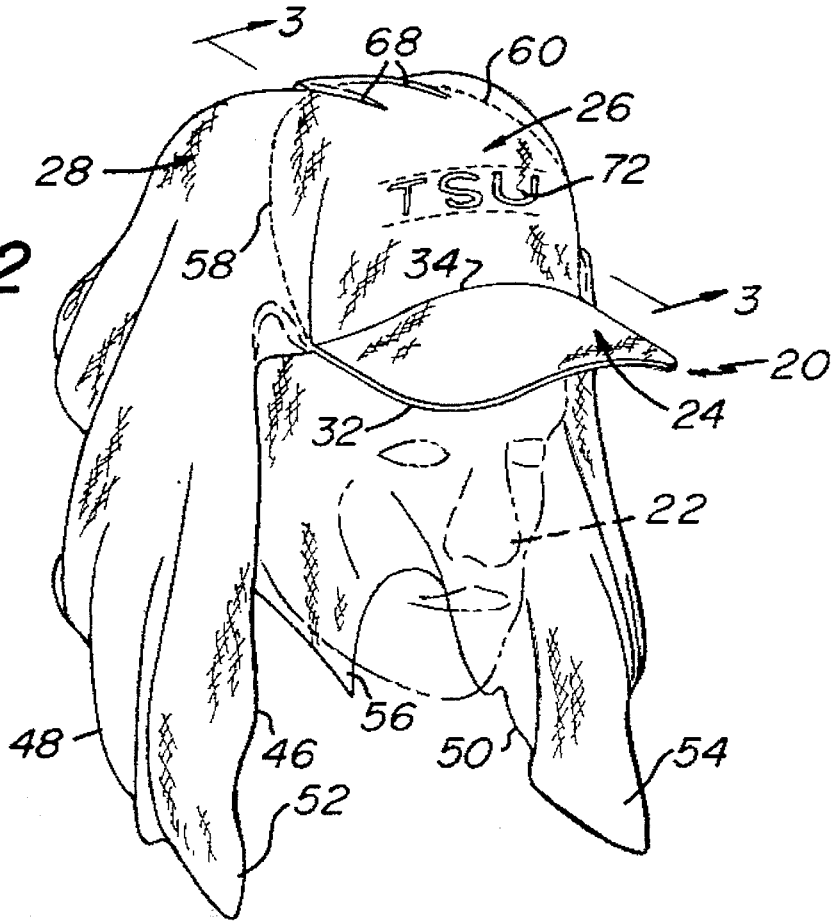
FIG. 2 is an isometric view of the front portion of the article of headwear shown in FIG. 1 but shown worn in a different manner on the head of a person.

Referring now to various figures of the drawing where like reference numerals refer to like parts there is shown at 20 in FIGS. 1–3, one embodiment of an article of headwear constructed in accordance with the subject invention and arranged to be worn on the head 22 (shown in phantom lines) of a person. In FIG. 1 the article of headwear is shown tied in place on the person's head, and in this regard the headwear forms what can be referred to as a "bandana-cap", whereas in FIG. 2 the article of headwear is shown merely draped over the person's head to form what can be called a "drape-cap." It should be pointed out at this juncture that the manner in which the article of headwear 20 is shown in FIG. 2 may represent an initial step in the securement of the headwear into the bandana-cap arrangement shown in FIG. 1, as will be described later.

Referring now to FIGS. 1 and 2 it can be seen that the article of headwear 20 basically comprises a visor brim 24 in the form of a bill, a self-supporting upstanding crown 26, a bandana cloth 28, and a moisture absorbent "sweat-band" strip 30. The bill is of any conventional construction, like that of a commercially available "baseball-type" cap. To that end the bill 24 is a generally planar member having an arcuate front edge 32 and an arcuate rear edge 34, and is formed of a compliant inner material layer 36 with a fabric covering 38 on its top surface and a fabric covering 40 on its under surface. The fabric of the coverings 38 and 40 may be the same or different. In any case the fabric of those coverings are preferably stitched together through the inner material layer 36, as is conventional. When so constructed the bill 24 can be bent out of its plane into the curved configuration shown in FIGS. 1–3 to form a curved visor which is disposed over the wearer's eyes to shield the wearer's eyes when the article of headwear 20 is in place.

The bandana cloth 28 is formed of a flexible fabric woven or knitted of any suitable material, e.g., cotton, Nylon, polyester, and blends thereof. In fact, the fabric need not be woven or knitted, at all so long as it comprises a thin, flexible sheet which is arranged to conform to the head of the wearer, and which can be tied in place. In accordance with the preferred embodiments of this invention, the "fabric" sheet or cloth 28 is of generally triangular shape having an outer surface 42, an inner surface 44, a front edge 46 and a pair of angularly extending side edges 48 and 50. The front edge 46 merges with the side edge 48 in a first pointed end 52, and merges with the other side edge 50 in a second pointed end 54. The two side edges 48 and 50 merge with each other in a third pointed end 56.

The crown 26 is a generally triangular shaped, slightly concave member similar in construction to the crown of a conventional baseball-type cap, and can be formed of a single panel or plural panels, of any conventional, self-supporting material, which form(s) a generally triangular shaped member having a pair of somewhat arcuate side edges 58 and 60, and a somewhat arcuate bottom edge 62. The crown is slightly concave in shape to include a concave inner surface 64 and a convex outer surface 66. The crown 26 is disposed under the bandana cloth at the middle of the front edge of the bandana cloth and with the inner surface of the bandana cloth closely and conformably engaging the convex surface of the crown. The bottom edge 62 of the crown is secured, e.g., sewn, to the arcuate rear edge 34 of the bill, while the side edges of the crown are secured, e.g., sewn, to the abutting inner surface of the bandana cloth, to form a self-supporting "crown portion" of the article of headwear. In lieu of being sewn the crown can be secured to the bandana cloth by lamination or other means, e.g., an adhesive. This crown portion is arranged to be disposed or sit on the forehead and contiguous top portion of the wearer's head, whereupon the brim is located above the person's eyes, while the remaining portion of the bandana cloth is draped over the wearer's head, such as shown in FIG. 2. From this configuration the three pointed ends 52, 54, and 56 of the bandana cloth can be secured to one another at the rear of the wearer's head, as shown in FIG. 1, whereupon the headwear takes on the configuration of the bandana-cap, referred to earlier.

As should be appreciated by those skilled in the art the crown portion of the headwear helps to hold the headwear at the proper position during the tieing of the bandana cloth pointed ends to each other. It also helps to hold the article of headwear in place when it is configured as the drape-cap of FIG. 2.

Once the bandana cloth is tied in place as shown in FIG. 1, the headwear 20 is quite resistant to accidental dislodgement, even when the wearer is active.

If secure retention of the headwear on the person's head is not required or desired, e.g., if the headwear is desired to be used merely as a shade to protect the wearer's head from the sun when the wearer is sitting or reclining during sun bathing, then the bandana's pointed ends 52, 54 and 56 need not be secured, i.e., knotted, together. In such a case the headwear is preferably arranged to form the drape-cap, i.e., the bandana cloth is merely be draped over the wearer's head like that shown in FIG. 2. This configuration is not only somewhat less confining than the bandana-cap arrangement of FIG. 1, but also provides additional shading for the wearer's neck area since the edge portions of the bandana cloth hang down over that area.

In the interests of sweat absorbency and to aid in the formation of the crown portion of the article of headwear, thereby facilitating the retention of the headwear so that the bill is located at the desired position on the wearer's head, the headwear includes the heretofore mentioned fabric strip 30. This strip is formed of any suitable material, such as the material(s) making up the sweat band of a conventional baseball-type cap. The strip 30 is an elongate member which is secured, e.g., sewn, to the rear edge 34 of the bill 24 and the front edge of the bandana cloth so that it forms an arcuate strip which stands up under the crown and contiguous portion of the bandana cloth, as shown in FIG. 3.

Figure 5:
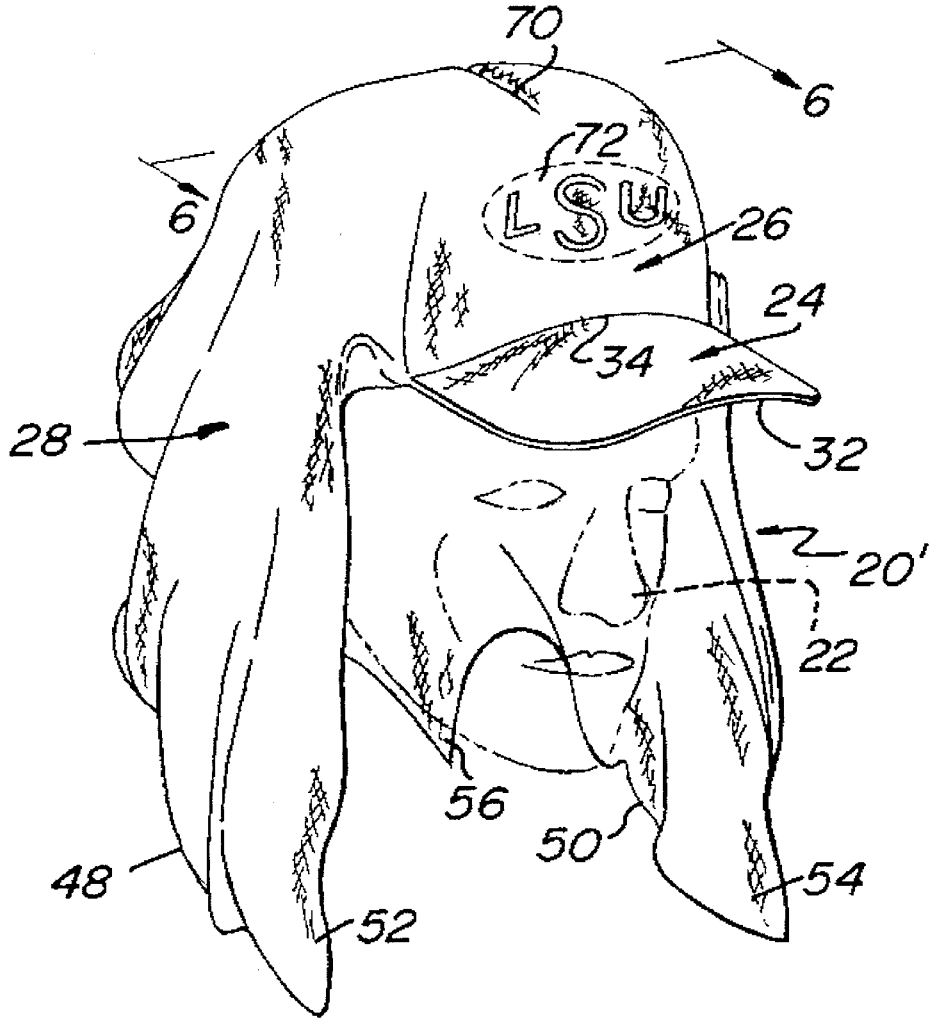
FIG. 5 is an isometric view of the front portion of a second embodiment of article of headwear shown worn in the same manner as in FIG. 2.
Figure 6:
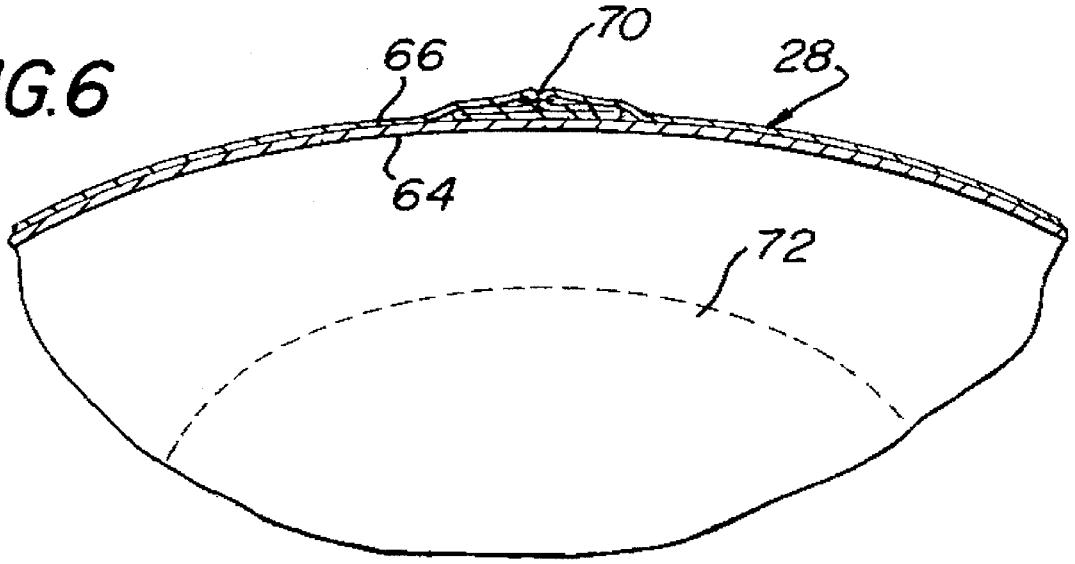
FIG. 6 is an enlarged sectional view taken along lines 6—6 of FIG. 5.

In order to ensure that the bandana cloth conforms to the crown, and to the wearer's head, the bandana cloth may include a pair of sewn or tacked pleats 68 as shown in FIGS. 1–4. Alternatively, the means for effecting the bandana's conformance to the wearer's head may comprise a single or plural sewn seam or "darts" in the fabric making up the bandana cloth. This later arrangement is shown in second embodiment 20' of this invention shown in FIGS. 5 and 6. The article of headwear 20' of the second embodiment is identical in construction to the first embodiment 20 described heretofore, except for the inclusion of a seamed dart 70 in lieu of the pair of pleats 68. Thus, in the interests of brevity the common components of the two articles of headwear 20 and 20' are given the same reference numerals, and their construction will not be reiterated herein.

In accordance with both preferred embodiments of this invention the portion of the bandana cloth which is disposed over the crown preferably has indicia 72 thereon. That indicia may be directly applied to the fabric of the bandana, e.g., by being printed or embroidered directly thereon, or may be in the form of a patch bearing the indicia and secured, e.g., sewn, onto the fabric of the bandana. In any case the indicia may comprise any type of graphic and/or text. In the embodiments shown herein the indicia represents the logo of a team, but such is merely exemplary of any type of indicia which may be applied to the article of headwear. In any case, and as will be appreciated by those skilled in the art, by being located on the self-supported crown portion of the headwear the indicia is readily visible to all.

Without further elaboration the foregoing will so fully illustrate my invention that others may, by applying current or future knowledge, adapt the same for use under various conditions of service.

I claim:

1. An article of headwear for disposition on the head of a person, said article comprising a visor brim, a crown, and a bandana cloth, said visor brim being in the form of a bill of a flexible, self-supporting material, said bill having a front edge and an arcuate rear edge, said bandana cloth comprising a triangular shaped flexible fabric having an outer surface, an inner surface, a front edge and a pair of angularly extending side edges, said front edge of said bandana cloth having a central portion, said front edge of said bandana cloth merging with each of said side edges in a pair of pointed ends, said side edges of said bandana cloth merging with each other in another pointed end, said arcuate rear edge of said bill being fixedly secured to said central portion of said front edge of said bandana cloth between said pair of pointed ends, said crown being a generally triangular shaped, slightly concave, member made of a self-supporting material and having a concave inner surface, a convex outer surface, an arcuate bottom edge and a pair of arcuate side edges, said crown being disposed under said bandana cloth with said inner surface of said bandana cloth engaging said convex surface of said crown, and said bottom edge of said crown being secured to said arcuate rear edge of said bill to form a self-supporting portion of said article of headwear arranged for disposition on the forehead of a person wearing the article of headwear so that said brim is located above the eyes of the person, whereupon the remaining portion of the bandana cloth can be disposed over the head with all the pointed ends thereof being releasably securable to one another by the formation of at least one knot thereat to secure the article of headwear in place.

2. The article of headwear of claim 1 additionally comprising a moisture absorbent band of fabric fixedly secured to said arcuate rear surface of said brim so that a portion of said strip overlies the concave inner surface of said crown.

3. The article of headwear of claim 2 additionally comprising indicia means on said bandana cloth in the area bounded by said crown.

4. The article of headwear of claim 1 additionally comprising indicia means on said bandana cloth in the area bounded by said crown.

5. The article of headwear of claim 1 wherein said brim is bendable, and, when bent, maintains its bent configuration.

6. The article of headwear of claim 1 wherein said crown is fixedly secured to said bandana cloth along at least a portion of the periphery of said crown.

* * * * *